US010859297B2

(12) United States Patent
Hartfield et al.

(10) Patent No.: US 10,859,297 B2
(45) Date of Patent: Dec. 8, 2020

(54) REFRIGERANT MANAGEMENT IN HVAC SYSTEMS

(71) Applicant: TRANE INTERNATIONAL INC., Davidson, NC (US)

(72) Inventors: Jon Phillip Hartfield, La Crosse, WI (US); Harry Kenneth Ring, Houston, MN (US); Michael William Groen, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 15/006,950

(22) Filed: Jan. 26, 2016

(65) Prior Publication Data

US 2016/0138842 A1 May 19, 2016

Related U.S. Application Data

(62) Division of application No. 14/347,521, filed as application No. PCT/US2012/057287 on Sep. 26, 2012, now abandoned.

(Continued)

(51) Int. Cl.
*F25B 39/02* (2006.01)
*F28F 9/013* (2006.01)

(Continued)

(52) U.S. Cl.
CPC ..... *F25B 39/028* (2013.01); *F25B 39/02* (2013.01); *F28D 3/02* (2013.01); *F28D 3/04* (2013.01);

(Continued)

(58) Field of Classification Search
CPC .. F25B 39/028; F25B 2339/0242; F28D 3/02; F28D 3/04; F28D 21/0017; F28F 9/0131; F28F 13/02; F28F 13/182
See application file for complete search history.

(56) References Cited

U.S. PATENT DOCUMENTS 2,247,107 A 6/1941 Waterfill
2,314,402 A 3/1943 Jones (Continued)

FOREIGN PATENT DOCUMENTS

JP 6-241615 9/1994
JP 6-241616 9/1994

OTHER PUBLICATIONS

International Search Report for PCT1US20121057287, dated Feb. 28, 2013, 3 pages.

(Continued)

*Primary Examiner* — Gordon A Jones
(74) *Attorney, Agent, or Firm* — Hamre, Schumann, Mueller & Larson, P.C.

(57) ABSTRACT

Generally, management of refrigerant in an evaporator of an HVAC chiller is described. Methods, systems, and apparatuses to manage refrigerant in an evaporator can include one or combination of the following approaches: (1) by use a refrigerant displacement array to physically prevent refrigerant from residing where the array is positioned; (2) by control of the interstitial velocity of refrigerant flow within the volume of the shell of an evaporator; (3) by a phase biased distribution of the refrigerant mixture, so that a gaseous portion is uniformly distributed into the evaporator shell, while liquid refrigerant and oil is distributed into the evaporator shell at a designated area; and (4) by preventing or reducing the occurrence of foaming inside the evaporator through anti-foaming surfaces, such as by the use of refrigerant phobic and lubricant phobic material(s). Refrigerant management can in turn improve the thermal performance and overall efficiency of the evaporator.

10 Claims, 13 Drawing Sheets

Related U.S. Application Data

(60) Provisional application No. 61/674,601, filed on Jul. 23, 2012, provisional application No. 61/539,325, filed on Sep. 26, 2011.

(51) Int. Cl.

| | |
|---|---|
| ***F28D 3/04*** | (2006.01) |
| ***F28D 3/02*** | (2006.01) |
| ***F28D 21/00*** | (2006.01) |
| ***F28F 13/02*** | (2006.01) |
| ***F28F 13/18*** | (2006.01) |

(52) U.S. Cl.

CPC ..... *F28D 21/0017* (2013.01); *F28F 9/0131* (2013.01); *F28F 13/02* (2013.01); *F28F 13/182* (2013.01); *F25B 2339/0242* (2013.01)

(56) References Cited

U.S. PATENT DOCUMENTS

| | | | | | |
|---|---|---|---|---|---|
| 3,180,408 | A * | 4/1965 | Grotz, Jr. | F22B 1/1823 | 165/134.1 |
| 3,197,387 | A * | 7/1965 | Richard | B01D 3/065 | 202/173 |
| 3,662,817 | A | 5/1972 | Kendrick et al. | | |
| 4,215,744 | A | 8/1980 | Bowles | | |
| 4,412,582 | A | 11/1983 | Mecozzi et al. | | |
| 5,063,663 | A | 11/1991 | Casterline | | |
| 5,567,215 | A | 10/1996 | Bielawski et al. | | |
| 5,836,382 | A * | 11/1998 | Dingle | F25B 39/028 | 165/160 |
| 6,516,627 | B2 * | 2/2003 | Ring | F25B 31/004 | 62/193 |
| 6,868,695 | B1 * | 3/2005 | Dingel | F25B 39/028 | 165/115 |
| 7,421,855 | B2 * | 9/2008 | Ring | F25B 39/028 | 62/512 |
| 7,545,644 | B2 | 6/2009 | Fedorov | | |
| 7,624,790 | B2 | 12/2009 | Max | | |
| 7,707,850 | B2 | 5/2010 | Wang et al. | | |
| 8,048,309 | B2 | 11/2011 | Osegovic et al. | | |
| 8,302,426 | B2 * | 11/2012 | de Larminat | F25B 39/028 | 62/515 |
| 9,347,715 | B2 * | 5/2016 | Schreiber | F25B 39/028 | |
| 9,759,461 | B2 * | 9/2017 | Numata | F25B 39/028 | |
| 2002/0117293 | A1 | 8/2002 | Campbell | | |
| 2002/0162352 | A1 | 11/2002 | Ring et al. | | |
| 2007/0107886 | A1 * | 5/2007 | Chen | F25B 39/02 | 165/161 |
| 2008/0190591 | A1 | 8/2008 | Ayub | | |
| 2010/0115950 | A1 | 5/2010 | Haje et al. | | |
| 2010/0243208 | A1 | 9/2010 | Kar et al. | | |
| 2011/0056664 | A1 * | 3/2011 | De Larminat | F25B 39/028 | 165/160 |
| 2011/0083619 | A1 | 4/2011 | Master et al. | | |
| 2011/0107512 | A1 | 5/2011 | Gilbert | | |
| 2011/0138838 | A1 | 6/2011 | Despesse | | |
| 2011/0198059 | A1 | 8/2011 | Gavillet et al. | | |
| 2011/0226005 | A1 | 9/2011 | Lee | | |
| 2011/0259574 | A1 | 10/2011 | Angel et al. | | |
| 2012/0018133 | A1 * | 1/2012 | Postma | F28D 3/02 | 165/104.21 |
| 2012/0118722 | A1 | 5/2012 | Holtzapple et al. | | |

OTHER PUBLICATIONS

Written Opinion for PCT/US2012/057287, dated Feb. 28, 2013, 8 pages.

Combined Search and Examination Report for Great Britain Application No. GB1511655.1, dated Sep. 30, 2015, 9 pages.

Combined Search and Examination Report for Great Britain Application No. GB1522821.6, dated Jan. 26, 2016, 5 pages.

* cited by examiner

REFRIGERANT MANAGEMENT IN HVAC SYSTEMS

This application claims the benefit of U.S. Provisional Application No. 61/674,601 filed on Jul. 23, 2012 and, titled REFRIGERANT MANAGEMENT IN HVAC SYSTEMS and claims the benefit of U.S. Provisional Application No. 61/539,325 filed on Sep. 26, 2011 and titled REFRIGERANT EVAPORATOR, the entirety of both the above-identified provisional applications are incorporated by reference herewith.

FIELD

The disclosure herein relates to heating, ventilation, and air-conditioning ("HVAC") systems, and more particularly to evaporators used in HVAC systems. Generally, methods, systems, and apparatuses are described that are directed to refrigerant management in an evaporator such as may be used in HVAC chillers.

BACKGROUND

Flooded and falling-film evaporators generally are known and often have a construction of a tube bundle within a shell. Such evaporators are typically used in HVAC chillers to cool a process fluid (e.g., water) which, in turn, is typically used in connection with a heat exchanger coil or air-handling unit to cool air moving through the coil or air-handling unit. Due to the interstitial spacing within the volume of the shell, such as between the tubes of the tube bundle, through which the process fluid flows, a relatively large quantity of liquid refrigerant may be required to wet the outside of all the tubes with refrigerant in order to achieve maximized efficiency of the evaporator. Excess liquid refrigerant between or adjacent the tubes next to the evaporator shell does not contribute to the overall efficiency of the HVAC chillers, and can be a burden on the cost of operating and maintaining chillers.

SUMMARY

Improvements may be made to the refrigerant management in evaporators used in HVAC chiller systems, which in turn can reduce refrigerant charge significantly without sacrificing thermal performance and the overall efficiency of the evaporator and, in some instances, can improve the thermal performance and the overall efficiency of the evaporator, such as at operation modes that may be at reduced or less than full load. Generally, methods, systems, and apparatuses to manage refrigerant in an evaporator are described, and which can include any one or combination of the following approaches.

In one approach, a refrigerant displacement array is used, which can include a number of spacers and/or baffles. The refrigerant displacement array physically prevents refrigerant from residing where the array is positioned.

In another approach, refrigerant management can be achieved by the distribution of the refrigerant mixture that enters the evaporator. The term "refrigerant mixture" herein generally refers to but is not limited, to one or more refrigerants, which may be present in one or more phases, e.g. liquid, gaseous, solid, and can include other non-refrigerant material(s) in one or more phases. For example, the refrigerant mixture can include a liquid refrigerant present in gaseous and liquid form, as well as a lubricant material such as oil or another refrigerant serving also as a lubricant material. For example, the refrigerant mixture can be distributed, into the shell of an evaporator, such as by using a distributor to distribute the gaseous portion of the refrigerant mixture in a manner of flow that is different relative to the distribution and manner of flow of the liquid portion of the refrigerant mixture. For example, the manner of flow of the gaseous portion may be optimized to achieve a desired flow to facilitate heat transfer, such as in a uniform flow through the distributor, while the manner of flow of the liquid portion may be concentrated, and distributed by the distributor from a designated area. Such phase biased distribution of the liquid versus the gaseous portion of the refrigerant mixture can be achieved.

In yet another approach, refrigerant management may be achieved by controlling the interstitial velocity of refrigerant flow within the volume of the shell of an evaporator.

In yet another approach, refrigerant management can be achieved by preventing or at least reducing the occurrence of foaming inside the evaporator. Surfaces within the evaporator can be made to be anti-foaming, for example by having one or more refrigerant phobic and lubricant phobic materials applied, formed, or otherwise put on surfaces within the evaporator.

In the approach of using a refrigerant displacement array, one embodiment of a method of refrigerant management in an evaporator of a HVAC chiller includes causing refrigerant to enter a volume present inside a shell of an evaporator. A portion of the volume present inside the shell is displaced with a refrigerant displacement array including spacers that physically extend from an inner surface of the shell at a lower portion thereof toward outer surfaces of tubes arranged in a tube bundle. The step of displacing a portion of the volume present inside the shell includes physically preventing refrigerant from residing in the portion of the volume where the spacers reside, such that no refrigerant is present in the portion of the volume displaced by the spacers. The outer surfaces of the tubes in the tube bundle are wetted with the refrigerant. The step of wetting in some embodiments includes attaining a mist or spray flow of the refrigerant through the interstitial volume within the shell including between outer surfaces of the tubes of the tube bundle and between outer surfaces of the tubes and outer surfaces of the spacers. The refrigerant inside the shell is evaporated by way of heat transfer with a process fluid traveling through the tubes of the tube bundle and the evaporated refrigerant is released from the shell.

One embodiment of a refrigerant management system for an evaporator of a HVAC chiller has the refrigerant displacement array. The system includes a shell having a volume to receive refrigerant to be evaporated therein, and a tube bundle disposed inside the shell. The tube bundle includes tubes extending within the shell to pass a process fluid therethrough and to undergo heat transfer with the refrigerant. The refrigerant displacement array includes a number of spacers to displace a portion of the volume of the shell. The spacers are disposed within the shell to physically extend from an inner surface of the shell at a lower portion thereof and toward outer surfaces of tubes of the tube bundle. The spacers physically prevent refrigerant from residing in the portion of the volume where the spacers reside.

In some examples, the refrigerant, displacement array includes a number of baffles to displace a portion of the volume in the shell, the portion of the volume being a portion of the interstitial volume between the tubes of the tube bundle. The baffles include openings, such as through holes, through which the tubes are insertable. In some embodiments, the openings have an inner diameter that is larger than an outer diameter of the tubes, and the baffles physically prevent refrigerant from residing in the portion of the interstitial volume where the baffles reside.

In the approach of using a certain distribution of the refrigerant mixture that enters the evaporator, for example by using a phase biased distributor, a method of refrigerant management in an evaporator of a HVAC chiller includes causing a refrigerant mixture to enter a distributor present on a lower portion of a shell that has a volume therein, and causing the refrigerant mixture to enter the volume present inside the shell. The step of causing the refrigerant mixture to enter the volume inside the shell can include, for example, distributing the refrigerant mixture into the shell, such as by using a distributor to distribute the gaseous portion of the refrigerant mixture in a manner of flow that is different relative to the distribution and manner of flow of the liquid portion of the refrigerant mixture. For example, the manner of flow of the gaseous portion may be optimized to achieve a desired flow to facilitate heat transfer, such as in a uniform flow through the distributor, while the manner of flow of the liquid portion may be concentrated, and distributed by the distributor from a designated area. A phase biased distribution of the liquid versus the gaseous portion of the refrigerant mixture can thus be achieved.

In one embodiment, phased biased distribution can include feeding a liquid, portion of the refrigerant mixture from one end of the distributor into the volume inside the shell, and feeding a gaseous portion present in the refrigerant mixture into the volume inside the shell from injection apertures disposed along a length portion of the distributor.

The outer surfaces of tubes in a tube bundle within the shell are wetted with refrigerant in the refrigerant, mixture. The refrigerant inside the shell is evaporated by way of heat transfer with a process fluid traveling through the tubes of the tube bundle, and the evaporated refrigerant is released from the shell.

One embodiment of a refrigerant management system for an evaporator of a HVAC chiller has a phase biased distributor. The system includes a shell having a volume to receive a refrigerant mixture therein. The shell has an inlet to receive the refrigerant mixture inside the volume of the shell, and an outlet to release from the shell refrigerant evaporated from the refrigerant mixture. A tube bundle is disposed inside the shell. The tube bundle includes tubes that extend within the shell to pass a process fluid therethrough and to undergo heat transfer with the refrigerant. The distributor is disposed at a lower portion of the shell, such as for example, proximate the bottom or on a lower side of the shell. The refrigerant mixture can be distributed into the shell of the evaporator using a flow conditioner and apertures of the distributor, so as to distribute the gaseous portion of the refrigerant mixture in a manner of flow that is different relative to the distribution and manner of flow of the liquid portion of the refrigerant mixture. For example, the manner of flow of the gaseous portion may be uniform through the apertures of the distributor, while the manner of flow of the liquid portion may be concentrated, and distributed by the distributor from a designated area. A phase biased distribution of the liquid versus the gaseous portion of the refrigerant mixture can thus be achieved. In some embodiments, the distributor includes a flow conditioner therein and injection apertures. The flow conditioner can be configured to feed a liquid portion of the refrigerant mixture from a designated location, such as at one end of the distributor into the volume inside the shell. The injection apertures are configured to feed a gaseous portion present in the refrigerant mixture into the volume inside the shell, such as for example along a length portion of the distributor.

In the approach of controlling the interstitial velocity of refrigerant flow within the volume of the shell of an evaporator, such as the interstitial two-phase velocity of known low pressure refrigerants, one embodiment of a method of refrigerant management includes causing refrigerant to enter a volume present inside a shell of an evaporator, and wetting outer surfaces of tubes in a tube bundle with the refrigerant. The step of wetting includes attaining; a mist or spray flow of the refrigerant, which may be in the form of both gaseous and liquid refrigerant, through the interstitial volume of the shell including between outer surfaces of the tubes of the tube bundle. The step of attaining a mist or spray flow of the refrigerant includes maintaining a target interstitial velocity of refrigerant flow suitable to attain the spray flow of refrigerant at or above a threshold interstitial velocity that does not attain the spray flow of refrigerant. The refrigerant inside the shell is evaporated by way of heat transfer with a process fluid traveling through the tubes of the tube bundle and evaporated refrigerant is released from the shell. In this approach, either or both of the refrigerant displacement array and the phase biased distributor can be used to facilitate attaining desired interstitial velocity of the refrigerant flow.

In the approach of using anti-foaming surfaces, one method of refrigerant management in an evaporator of an HVAC chiller includes causing refrigerant to enter a volume present inside a shell of an evaporator, and wetting outer surfaces of tubes in a tube bundle with the refrigerant. Refrigerant inside the shell is evaporated by way of heat transfer with a process fluid traveling through the tubes of the tube bundle. The formation of foam by one or more of the refrigerant and lubricant during the evaporating step is reduced. The step of reducing formation of foam includes causing the refrigerant to interact with anti-foaming surfaces present within the shell. The evaporated refrigerant is released from the shell.

One embodiment of a refrigerant management system for an evaporator of an HVAC chiller has the anti-foaming surfaces. The system includes a shell having a volume to receive a refrigerant mixture therein, and a tube bundle disposed inside the shell. The tube bundle includes tubes extending within the shell to pass a process fluid therethrough and to undergo heat transfer with the refrigerant. Anti-foaming surfaces are disposed within the volume of the shell. The anti-foaming surfaces are arranged and configured inside the shell to interact with the refrigerant mixture and are suitable to prevent or at least reduce foaming that may occur.

It will be appreciated that anti-foaming surfaces may be created through use of known or novel materials, coatings, surface enhancements, novel mesh material, and combinations thereof. In some embodiments, the anti-foaming surfaces can be one or both of refrigerant phobic surfaces and lubricant phobic surfaces disposed within the volume of the shell. It will also be appreciated that the use of anti-foaming surfaces is not limited to evaporators as other apparatuses, devices, and components of HVAC systems including but not limited to chillers may employ such anti-foaming surfaces. For example, such refrigerant management approach may be employed in an oil and/or refrigerant tank or source of HVAC chillers.

Other features and aspects of the refrigerant management approaches will become apparent by consideration of the following detailed description and accompanying drawings.

BRIEF DESCRIPTION OF THE DRAWINGS

Reference is now made to the drawings in which like reference numbers represent corresponding parts throughout.

DETAILED DESCRIPTION

Improvements may be made to the refrigerant management in evaporators used in HVAC chiller systems, which in turn can reduce refrigerant charge significantly without sacrificing thermal performance and the overall efficiency of the evaporator and, in some instances, can improve the thermal performance and the overall efficiency of the evaporator. Generally, methods, systems, and apparatuses to manage refrigerant in an evaporator are described, and which can include any one or combination of the following approaches: (1) use of a refrigerant displacement array to physically prevent refrigerant from residing where the array is positioned; (2) control of the interstitial velocity of refrigerant flow within the volume of the shell of an evaporator; (3) use of phase biased distribution of the refrigerant mixture, so that a gaseous portion is distributed into the evaporator shell in manner of flow that is different from the distribution and manner of flow of liquid refrigerant and oil into the evaporator shell, for example where the gaseous portion is distributed to achieve uniform flow and interstitial velocities and the liquid portion is distributed from a designated and/or concentrated location; and (4) using foam abatement with anti-foaming surfaces, such as by the use of refrigerant phobic and/or lubricant phobic material(s) to prevent or reduce the occurrence of foaming inside the evaporator. Refrigerant management using such approach(es) can reduce refrigerant charge significantly without sacrificing thermal performance and the overall efficiency of the evaporator and, in some instances, can improve the thermal performance and the overall efficiency of the evaporator.

Figure 1:
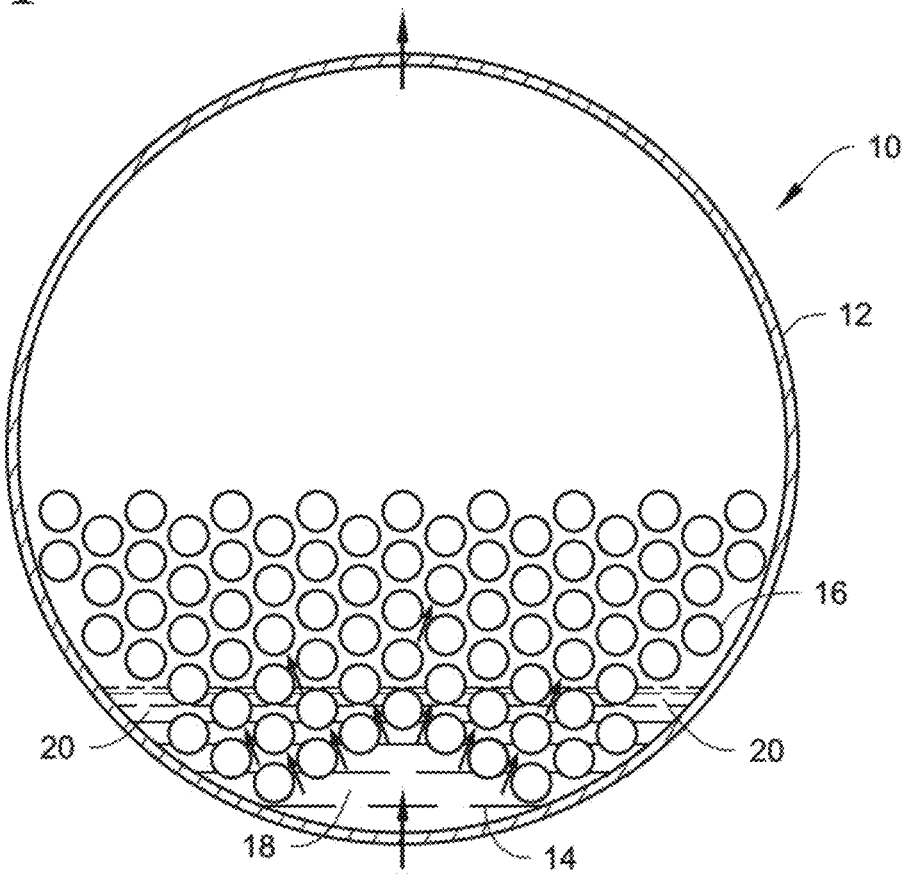
FIG. 1 is an end view inside a shell and tube flooded evaporator.

As to the basic design of a flooded evaporator which is referred to throughout the descriptions herein, FIG. 1 shows an end view of a basic flooded evaporator 10. The evaporator 10 has a shell 12 where a mixture of refrigerant 14 is on the outside of the tubes 16 and is vaporized by heat transfer from the process fluid on the inside of the tubes 16. In many cases, the mixture of refrigerant 14 is present in two phases of a gaseous and liquid portion, and enters a lower portion of the shell 12, such as at the bottom of the shell 12. The shape of the tube 16 arrangement at the bottom 18 is to allow room for a distributor (not shown in FIG. 1).

The distributor, which is further described below in FIGS. 15-19, is designed to introduce the gaseous portion of the refrigerant mixture 14 in a manner of flow that is different from the distribution and manner of flow of the liquid portion. In some instances, the gaseous portion may be distributed from the distributor along a length portion or direction of the evaporator shell and sometimes in uniform manner as may be needed for desired and/or certain performance. For example, gas can be distributed relatively evenly along the length of the shell 12, but the liquid distributed from a designated location, such as toward an end. By placing more liquid at a concentrated location, such as at one end of the shell relative to the other, for example, the place where the highest oil concentration exists can be controlled. The description of FIGS. 15-19 hereinbelow provide further details of such a distributor. Also, U.S. Pat. No. 6,516,927 describes the issues with management of liquid phase and pool migration, and the entirety of which is herewith incorporated by reference.

In FIG. 1, twelve rows of tubes 16 are shown, but this is meant as one example only, as it will be appreciated that the number of rows can vary as well as the number of tubes in a row. Gas and liquid enter the tube bundle from the bottom of the shell. If the amount of gas flow is low enough so that the velocity upward between the tubes is low, then the interstitial area around the bottom tube rows of the evaporator are essentially a pool of liquid with bubbles rising through the liquid, somewhat like bubbles rising from the bottom of a boiling pan of water, or bubbles from a scuba diver rising to the top of the lake. This is referred to as "bubbly flow" for this discussion. Bubbly flow is not desired for minimizing refrigerant charge in an evaporator and for achieving suitable thermal management, which may be reduced due to head pressure raising the liquid refrigerant boiling point.

It will be appreciated that as the refrigerant flows through the tubes 16, each row up from the bottom has a larger volume of gas that flows through it. For example, gas from the lower rows enters the spaces in the upper rows. Gas generated by the lower rows is added to the volume flow of upper rows, so that the gas entering the upper rows is greater than the amount of gas entering lower rows, and so on up the tube bundle. As the volume of gas flow increases up through the tube bundle, the velocity can increase so that there is no longer a liquid pool with bubbles floating up through the pool. In this manner, there can be a change in the basic two-phase flow pattern to a "spray flow" where droplets of liquid are carried up through the tube bundle to wet the tubes, and where gas flow entrains the liquid droplets.

Bubbly flow has a much higher percent of liquid in the space between tubes than spray flow, so spray flow has been determined to be more desired for minimizing refrigerant charge in the evaporator. The quality of the spray flow can adequately wet the tubes to achieve efficient thermal transfer, while requiring less refrigerant charge or inventory in the evaporator relative to bubbly flow which as described above has more liquid and is subject to pooling at various locations in the evaporator, such as at the bottom of the shell. If the quality of the spray flow can be attained throughout the tube bundle of the evaporator, desirable refrigerant management can be achieved, to thereby minimize refrigerant charge or inventory, which can reduce parasitic loss due to pressure differences in the tube bundle, and to thereby maintain or increase efficiency of the evaporator.

Referring to the lower left of FIG. 1, "wasted space" 20 near the perimeter of the shell 12 is usually present in many evaporators. This volume adjacent to the lower part of the shell 12 can be completely displaced without adversely affecting the performance of the evaporator.

Figure 2A:
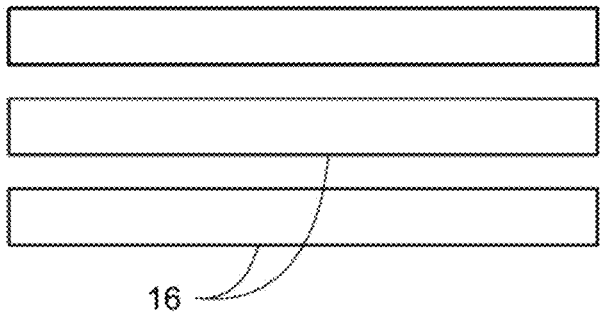
FIG. 2A is a schematic side view of a tube bundle.
Figure 2B:
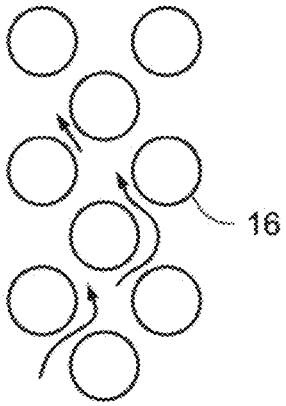
FIG. 2B is a schematic end view of a tube bundle showing interstitial volume between outer surfaces of tubes and a representation of interstitial velocity of a refrigerant mixture flow through the tube bundle.

As mentioned above, a refrigerant mixture entering the evaporator can typically have two phases of refrigerant, as well as other materials. There can be cases where only liquid enters, but this may be a less frequent operating condition. If the velocity V between the tubes 16 (interstitial velocity) is greater than a minimum threshold, then "spray flow" can be developed. If the velocity $V_i$ is below the threshold, then "bubbly flow" occurs. See e.g. FIGS. 2A and 2B respectively for a representation of the tube bundle alone and the interstitial velocity through the tubes (see arrows through between tubes 16 in FIG. 2B).

Bubbly flow is not wanted, so if a refrigerant displacement array is added, such as a series of spacers and/or baffles, the effective interstitial velocity can be increased. However, in operating conditions where interstitial velocity is above the threshold required to obtain the spray flow, then a series of spacers and/or baffles needed may be less or may not be required.

In one approach to facilitate attaining the spray flow condition, the refrigerant displacement array displaces volume that would otherwise be taken up by the refrigerant mixture including the "wasted space" 20 described earlier. If there is little or no gas entering the bottom rows of tubes, the addition of the refrigerant displacement array can displace liquid at the bottom of the tube bundle, but can still serve to help increase the interstitial flow regime to a spray flow that minimizes or otherwise reduces interstitial volume that could be subject to "bubbly flow".

For example, by introducing the refrigerant displacement array, it is possible for the gaseous portion of the refrigerant mixture to exceed the threshold velocity by reducing the length of the interstitial area between the tubes, e.g. along the axial length of the tubes. Since the flow area is reduced, the upward gas velocity can be increased to attain the spray flow and avoid bubbly flow.

Refrigerant Displacement Array FIGS. 1-14

Figure 3:
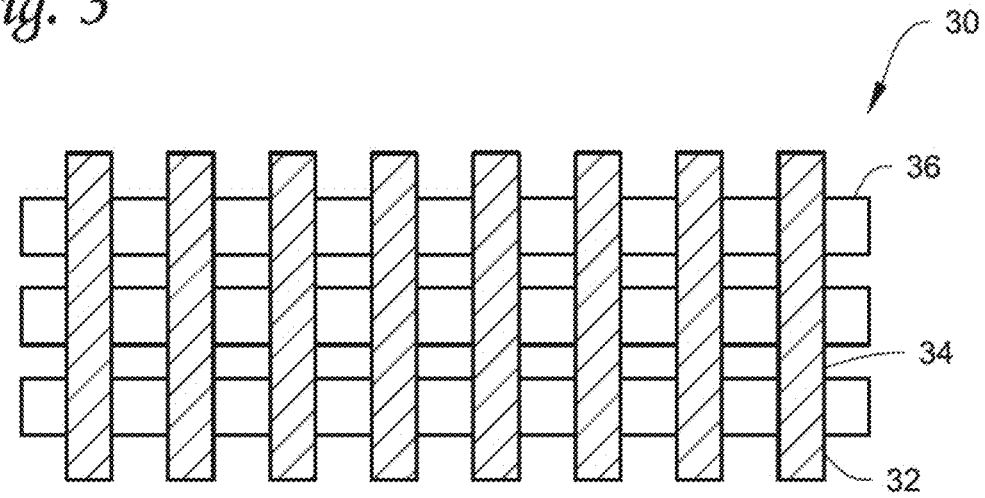
FIG. 3 is a schematic side view of a tube bundle with one embodiment of a refrigerant displacement array having spacers and baffles connected thereto.
Figure 4:
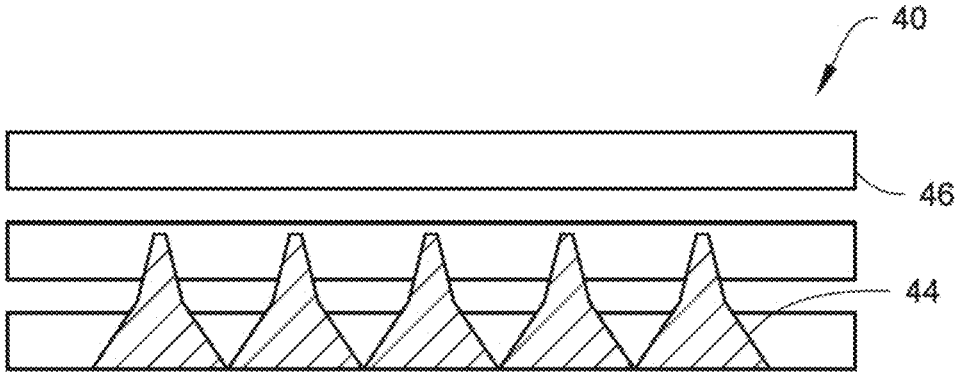
FIG. 4 is a schematic side view of a tube bundle with another embodiment of a refrigerant displacement array with spacers and baffles.
Figure 5:
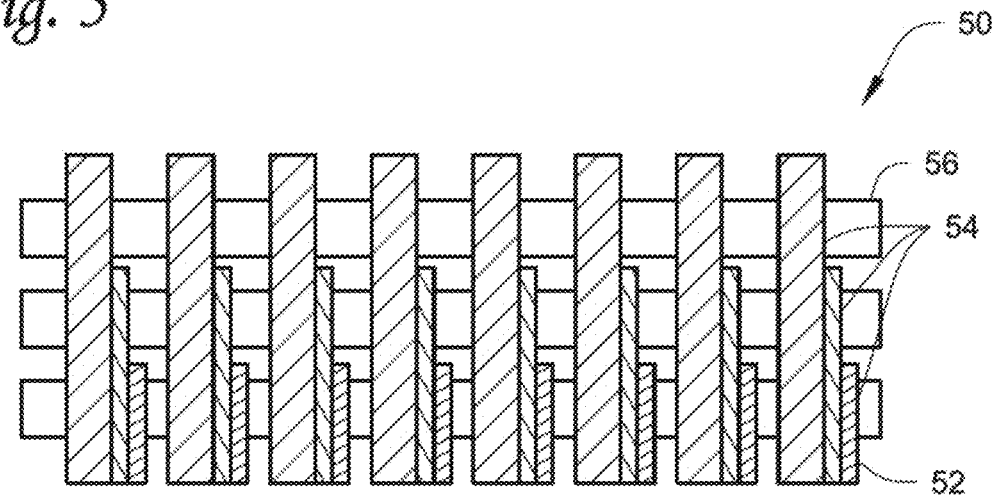
FIG. 5 is a schematic side view of a tube bundle with another embodiment of a refrigerant displacement array with spacers and baffles.

FIGS. 3-5 show examples of refrigerant displacement arrays, that can include a series of spacers and baffles that physically reside within is shell of an evaporator. For example, spacers are meant to refer to the portion used at a lower portion of the shell, such as toward the bottom of the shell and toward the lower part of the tube bundle. The spacers can butt up against the evaporator shell wall. Baffles are meant to refer to the portion used in an upper portion of the shell and around the tubes of the tube bundle. It will be appreciated that baffles may include a "spacer" portion at the bottom of the baffle, but for ease of description they are hereafter referred to as baffles.

FIG. 3 is a side view of a tube bundle 36 with one embodiment of a refrigerant displacement array 30 having spacers 32 and baffles 34 connected thereto. FIG. 3 shows a baffle side that is substantially vertically straight, but it will be appreciated that the side profile can vary as desired and/or suitable.

For example, FIG. 4 is a side view of a tube bundle 46 showing another embodiment of a refrigerant displacement array 40 with baffles 44 having a varied side profile. Although bottom spacers are not shown, it will be appreciated that spacers may be included with the baffles 44. Baffles 44 are shown with a side profile that tapers outward from the top toward the bottom for example as variable width baffles. It will be appreciated that the side profile as desired and/or necessary can vary from the profile specifically shown.

FIG. 3 shows full height baffles 34 extending the height of the tube bundle 36, and FIG. 4 shows partial height baffles 44 that extend partially up the tube bundle 46. It will be appreciated that full, partial, or a combination of both can be used in either of the arrays 30, 40 of FIGS. 3 and 4.

For example, FIG. 5 shows a side view of a tube bundle 56 with another embodiment of a refrigerant displacement array 50 with spacers 52 and baffles 54. As shown, the baffles 54 are of varied height.

Generally, the refrigerant displacement array, with the series of spacers and/or baffles, is positioned to displace refrigerant causing the amount of refrigerant charge in the evaporator to be reduced. In addition to displacing refrigerant, the presence of and spacing of the spacers and/or baffles can maintain interstitial velocities between the tubes in a range whereby two phase spray flow of the refrigerant is achieved rather than bubbly flow of the refrigerant, e.g. bubbles of refrigerant gas rising through a pool(s) of refrigerant liquid. In some embodiments, the thickness of a baffle or a spacer can be about 0.25 to about 0.5 inches. It will be appreciated that the thickness can vary and may be somewhat larger or smaller than the above range, but there may be a limit to how thick a baffle may be so as to allow the refrigerant mix to freely move through the baffle, such as through the openings or through holes of the baffle (see e.g. FIGS. 7 to 12 below for further description of the openings.

Figure 6:
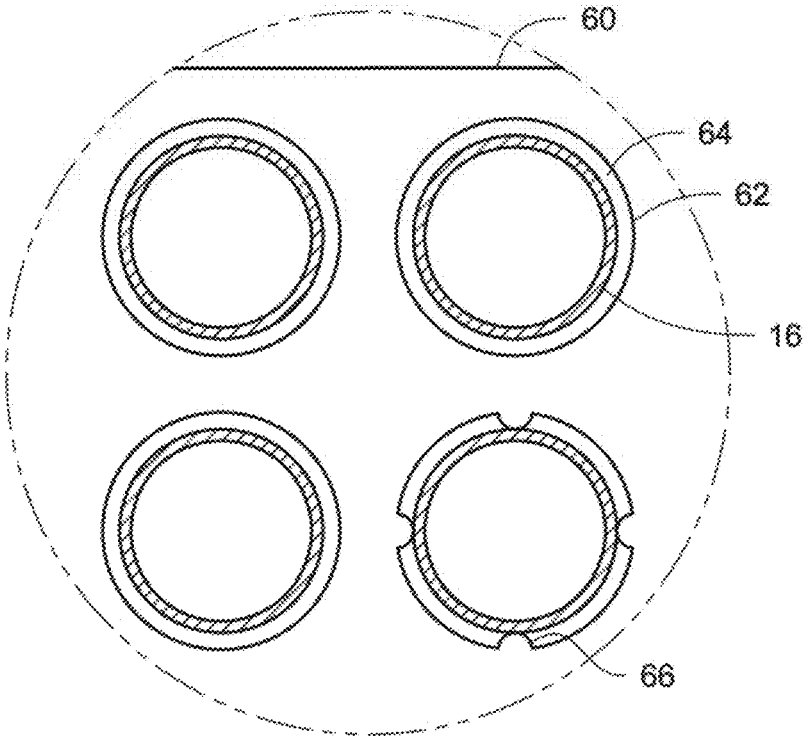
FIG. 6 is an end view of a tube bundle with tubes inserted through holes of one embodiment of a baffle that shows an embodiment of projections within one of the holes.

To insert the tubes through baffles of the refrigerant displacement array, openings such as for example through holes can be used. FIG. 6 is an end view of part of a tube bundle with tubes 16 inserted through holes 62 of one embodiment of a baffle 60. It will be appreciated that a space or gap 64 is present between tubes 16 and the baffle 60, e.g. inner diameter of the holes 62. FIG. 6 also shows one embodiment for maintaining an annular gap by using projections 66 within one of the holes. The projections 66 can be disposed on the inner diameter of the holes 62 to provide a standoff for the tubes 16 to avoid contact with the inner diameter. It will be appreciated that any of the spacers/baffles described herein can have the projections 66 within the through holes. The clearance, e.g. diametral clearance, between the inner diameter of the hole and the outer diameter of the tube can depend upon tube diameter, for example for larger diameter tubes, e.g. 1 inch tubes, a higher clearance may be desired and/or needed, but for smaller diameter tubes, e.g. ¾ inch tubes, a lower clearance may be desired and/or needed. In some examples, about 0.1875 inch diametral clearance can be used for 1 inch diameter tubes, and about 0.125 inch diametral clearance can be used for ¾ inch diameter tubes. In some instances, there may be a clearance between the outermost projecting surface of the projections 66 and the outer diameter of the tubes. Such clearance may be for example about 1/32 inch.

FIGS. 7 to 10 show various embodiments of spacers and baffles (partial and full height) that can be used alone or in some combination to construct a refrigerant displacement array.

Figure 7:
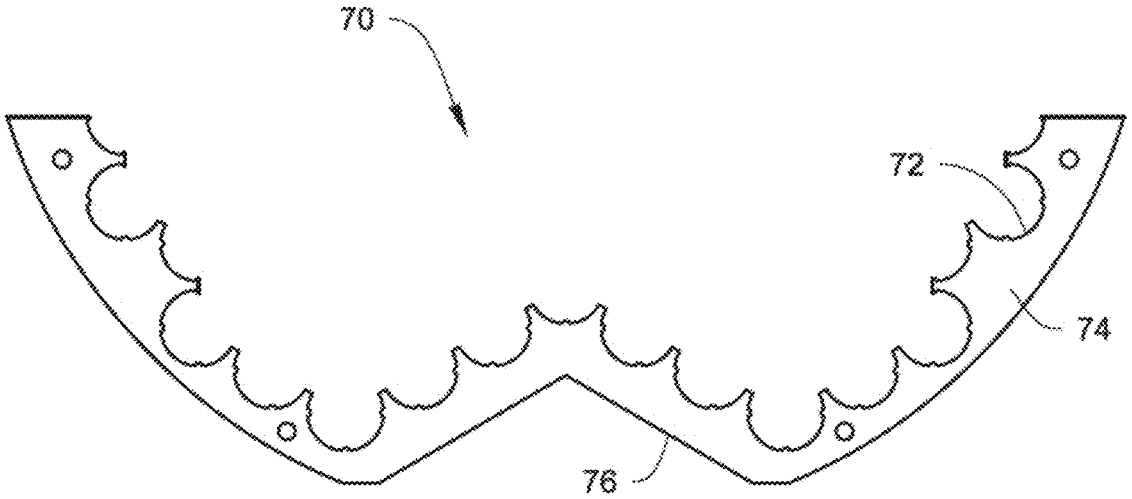
FIG. 7 is a side view of one embodiment of a spacer for to refrigerant displacement array.
Figure 8:
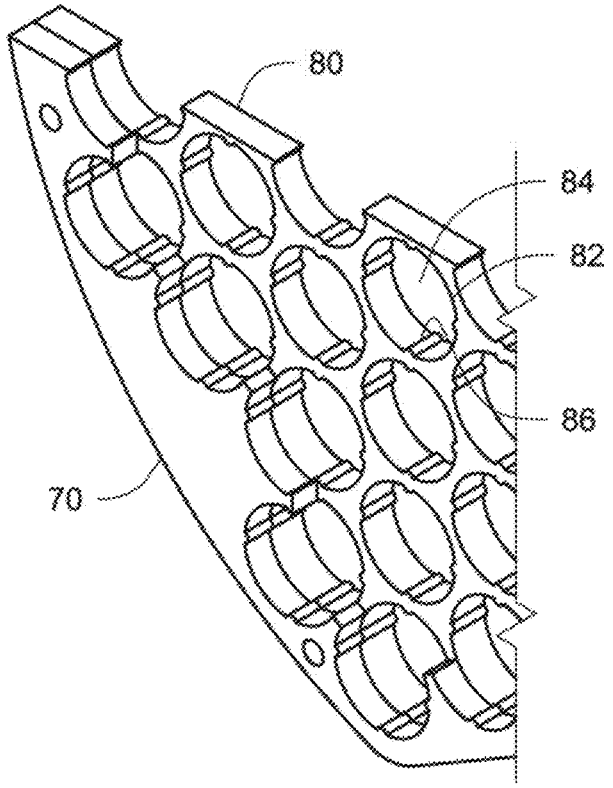
FIG. 8 is a picture of a spacer used as a split spacer assembled to one embodiment of a baffle.
Figure 9:
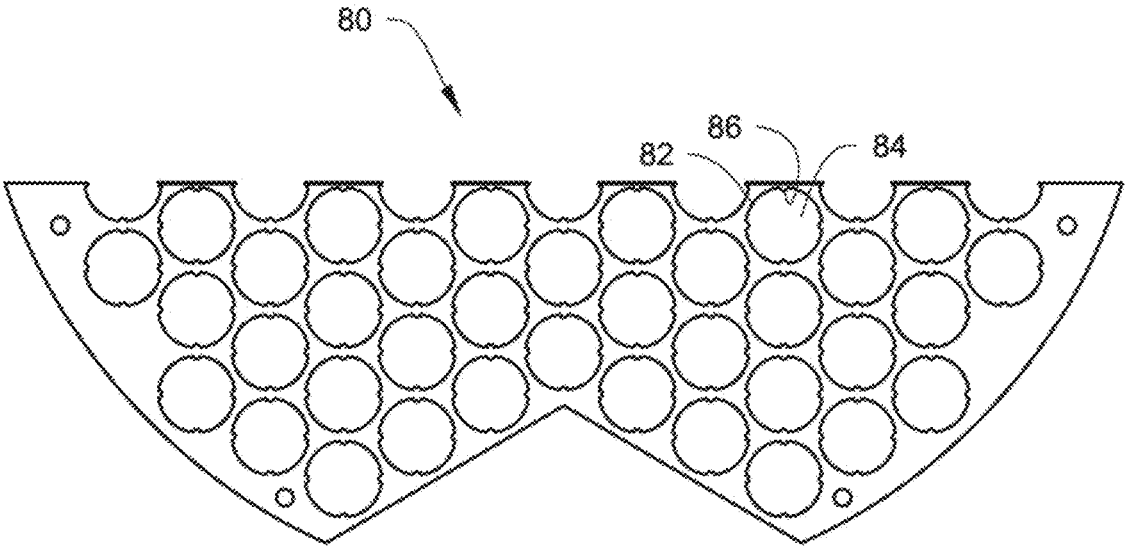
FIG. 9 is a side view of another embodiment of a spacer and baffle shown alone, the baffle is a partial height baffle.

FIG. 7 is a side view of one embodiment of a spacer 70 for a refrigerant displacement array. The spacer 70 has grooves or cutouts 72 proximate a top on which to allow tubes of a tube bundle to rest, and can also include the projections or standoffs as shown in FIG. 7. The spacer 70 has portions 74, 76 that can displace volume within the shell of the evaporator, such as between a lower portion of the shell and the tubes toward the bottom portion of the bundle (e.g. at 74), and between a distributor and tubes toward the bottom of the bundle (e.g. at 76). FIG. 8 shows a picture of the spacer 70 that may be used as a split spacer assembled to one embodiment of a baffle 80, which may be partial or full height. The baffle 80 has through holes 82 with an opening 84 through which tubes can be inserted. The baffle 80 can also have projections 86, such as already described, above. FIG. 9 is a side view of the baffle 80 (with a bottom spacer portion) shown alone, the baffle is a partial height baffle.

Figure 10:
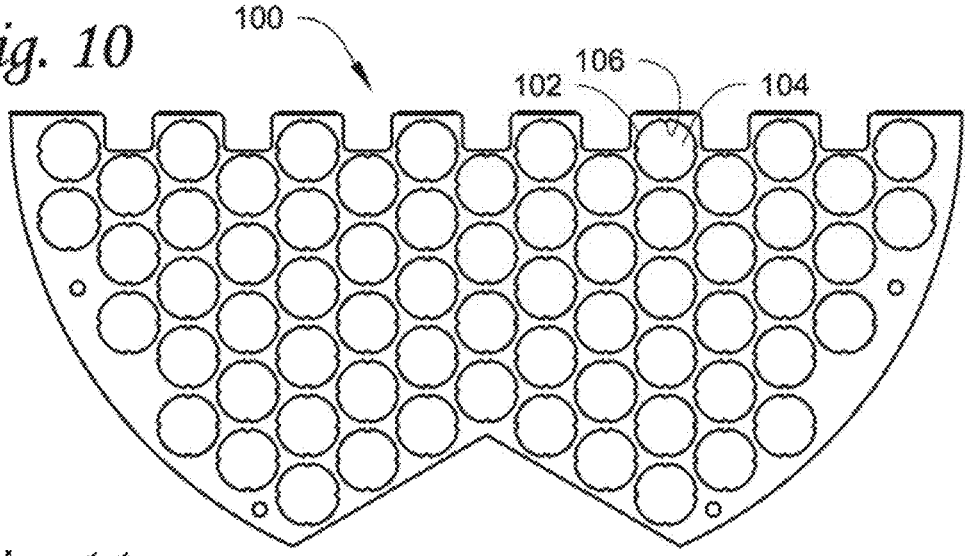
FIG. 10 is a side view of one embodiment of a spacer and baffle shown alone, the baffle is a full height baffle.

FIG. 10 is a side view of another embodiment of a baffle 100 (with bottom spacer portion) shown alone. The baffle 100 is a full height baffle, and includes through holes 102 with an opening 104 through which tubes can be inserted. The baffle 100 can also include projections 106 as similarly described above.

Figure 11:
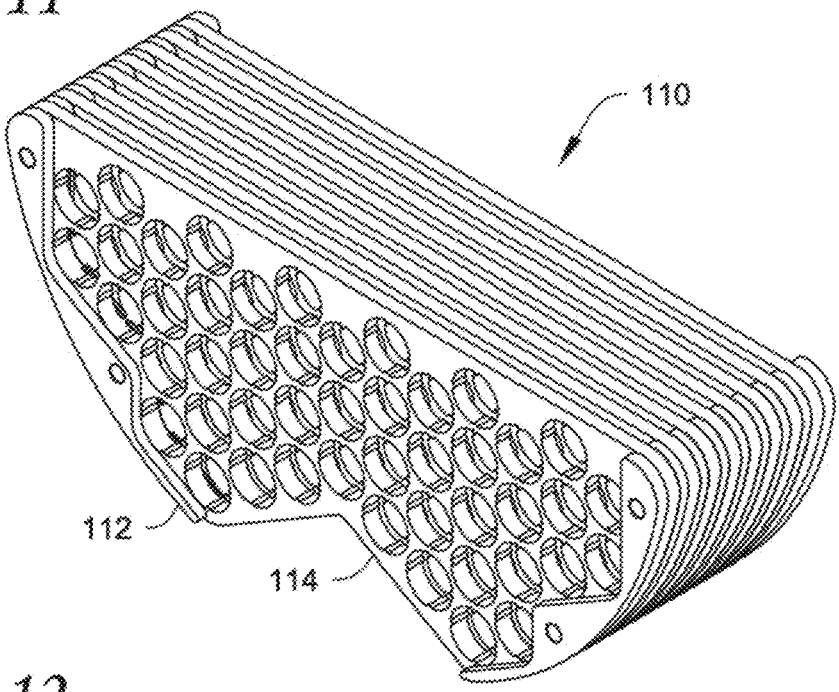
FIG. 11 is a perspective view of another embodiment of a refrigerant displacement array, which includes alternating spacers and spacers with full height baffles.
Figure 12:
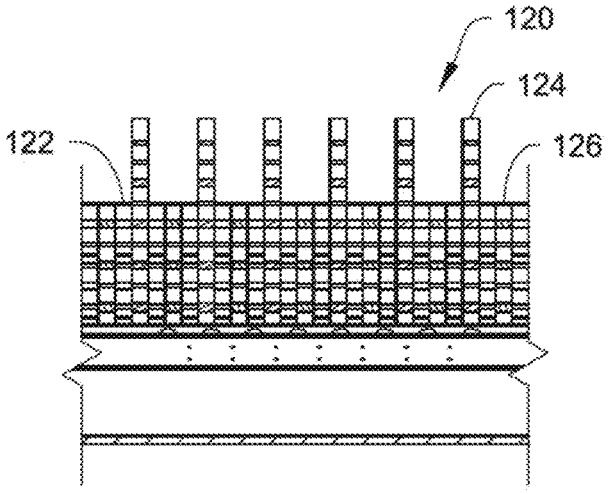
FIG. 12 is a side view of another embodiment of a refrigerant displacement array, which includes a series of spacers, and spacers with full and partial height baffles.

FIGS. 11 and 12 show partial views of additional examples for a construction of a refrigerant displacement array. FIG. 11 is a perspective view of another embodiment of a refrigerant displacement array 110. The refrigerant displacement array is constructed to include a series of alternating spacers 112 and full height baffles 114 (with bottom spacer portions). As one example only, the array of FIG. 11 could be used along the length inside an evaporator shell, and the baffle/spacer alternating arrangement could repeat at about 1 inch intervals, where along a 70 inch long evaporator, there may be about 70 baffles and 70 spacers. Depending on the longitudinal spacing (lengthwise within the evaporator shell) of the baffles/spacers, the need for certain traditional tube supports could be reduced or eliminated. FIG. 12 is a side view of another embodiment of a refrigerant displacement array 120, which includes a series of spacers 122, and full and partial height baffles, 124, 126, which can also include bottom spacer portions to connect to adjacent spacers 122.

Figure 13A:
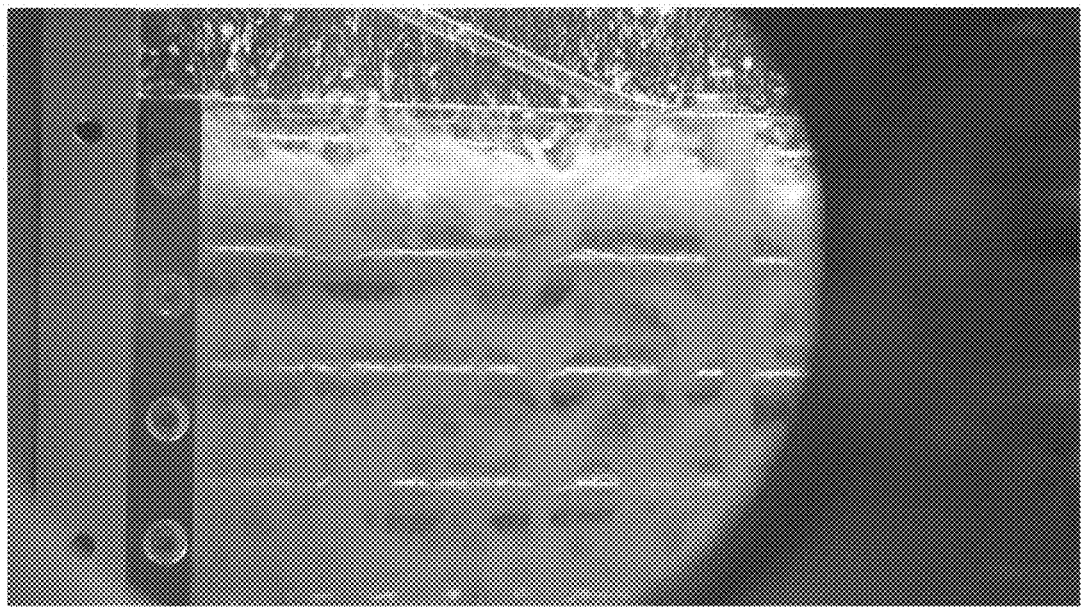
FIG. 13A is a picture of an evaporator in operation without a refrigerant displacement array and showing "bubbly" flow or non-mist/spray flow.
Figure 13B:
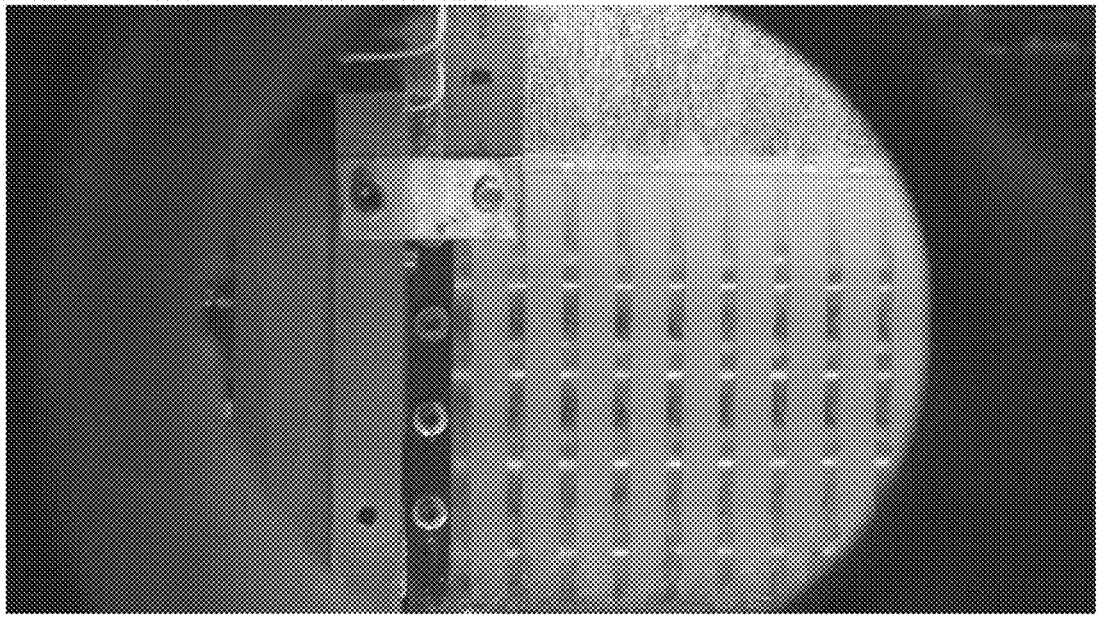
FIG. 13B is a picture of an evaporator in operation with a refrigerant displacement array having a series of full height baffles and that shows the spray/mist flow during heat transfer.

FIGS. 13A and 13B show pictures that illustrate operation of an evaporator without a refrigerant displacement array (FIG. 13A) compared to operation of an evaporator with a refrigerant displacement array having a series of full height baffles (FIG. 13B). As described above, if the amount of gas flow is low enough so that the velocity upward between the tubes is low, then the interstitial area around the bottom tube rows of the evaporator can be subject to pooling of liquid with bubbles rising through the liquid, i.e. "bubbly flow". As seen in the pictures, bubbly flow would be expected to have a much higher percent of liquid in the space between tubes than spray flow (FIG. 13B). The quality of the spray flow adequately wets the tubes to achieve efficient thermal transfer, while requiring less refrigerant charge or inventory in the evaporator relative to bubbly flow which, as described above, has more liquid and is subject to pooling at various locations in the evaporator, such as at the bottom of the shell or other areas that may be subject to low velocity without the use of the refrigerant displacement array. FIG. 13A shows a velocity that is less than the threshold velocity which results in the bubbly flow, whereas FIG. 13B shows velocity at or above a threshold velocity to attain the desired spray flow.

Figure 14:
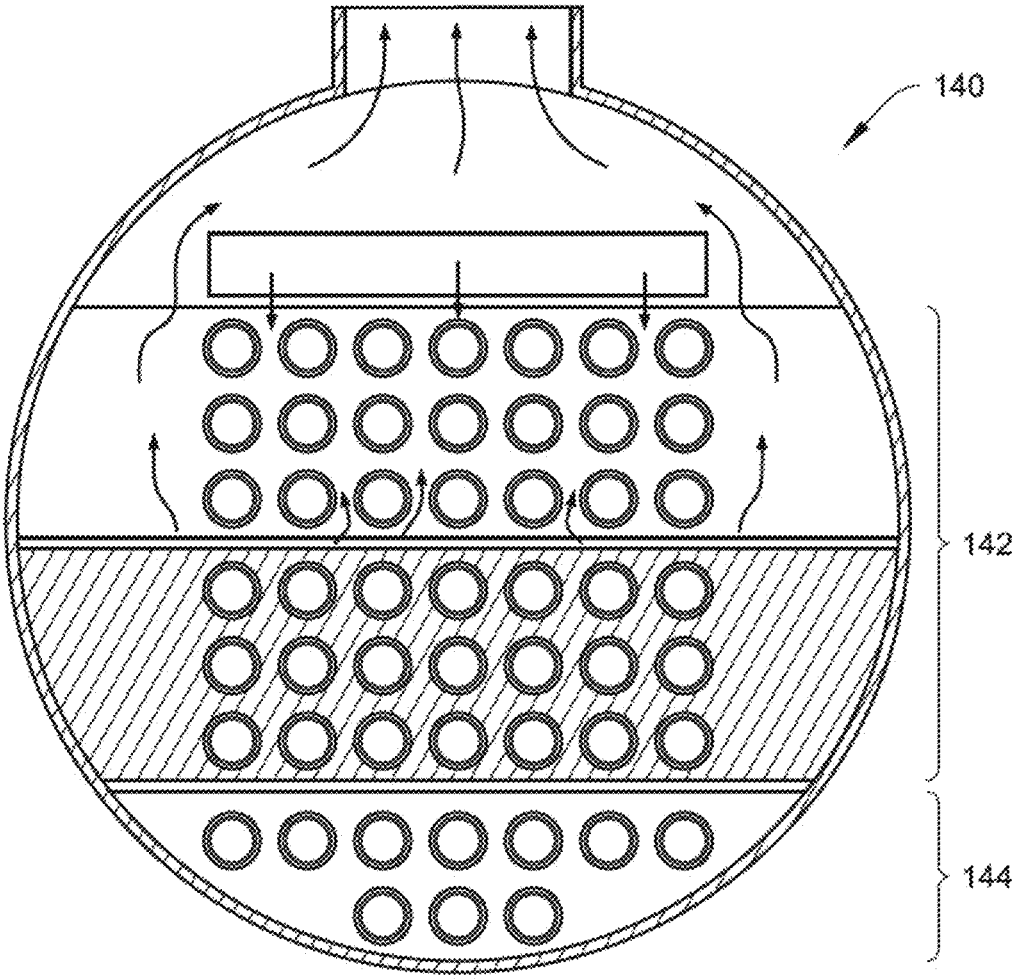
FIG. 14 is an example of a falling film flooded evaporator, within which a refrigerant displacement array can be implemented.

FIG. 14 is an example of a falling film flooded evaporator 140, within which any of the refrigerant displacement array described herein could be implemented. In some instances, falling film evaporators have different refrigerant flow characteristics and can have different flow velocity issues. The falling film evaporator 140 can be known to have a falling film region 142, where liquid flows downward from tube to tube of the bundle (e.g. top to bottom via gravity). Vapor can more easily escape upward and outward, so there may not be an advantage to have full height baffles. However, a pool zone 144 may be present in the evaporator 140 during operation, and so spacers and partial height baffles could be used to displace such liquid pooling to help facilitate efficient evaporation through high vapor velocity and to limit refrigerant charge. For example, baffles and/or spacers could be implemented in the pool zone 144 and into a portion of the middle height of the tube bundle within the falling film region 142.

Phase-Biased Distributor FIGS. 15-19B

Figure 15:
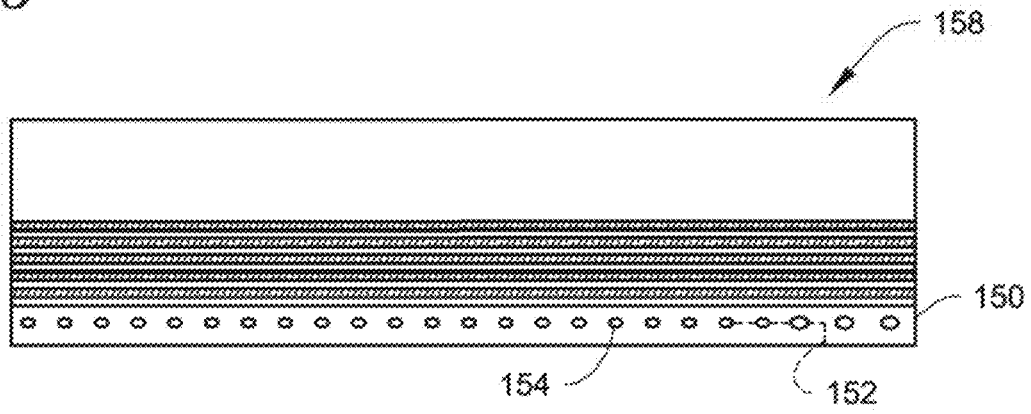
FIG. 15 is a schematic side view of one embodiment of as distributor within an evaporator.
Figure 16A:
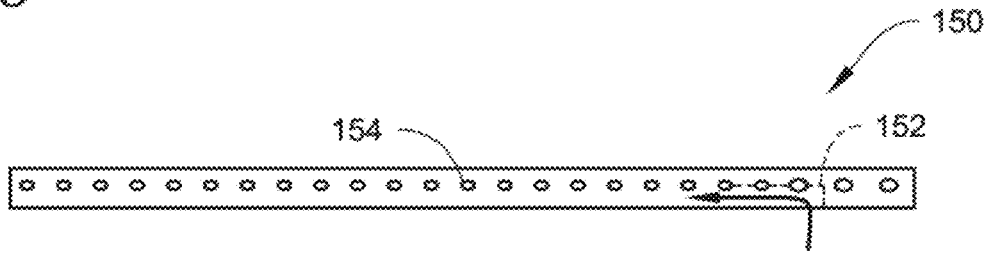
FIG. 16A is a schematic side view of the distributor from FIG. 15 shown alone.

FIGS. 15 and 16A and B show embodiments of a phase biased distributor. Generally, the phase biased distributors described herein are designed for bottom feed from the bottom of the evaporator shell, by introducing the gas of the refrigerant into the evaporator shell as needed for certain or optimum performance, for example by distributing gas evenly along a length portion of the shell 12. It will be appreciated that the distributors described herein are not limited to bottom mount configurations, but may be disposed at other portions, e.g. relatively upper or lower or side portions of the shell as may be desired and/or needed, or example depending on the particular implementation.

Through the distributor, liquid is distributed from a localized part of the distributor, such as toward an end(s) or otherwise dedicated location(s) thereof. By placing more liquid, for example at one end of the shell relative to the other, the location where the highest oil concentration exists can be controlled, which can be desirable for lubricant management and recovery.

FIG. 15 is a side view of one embodiment of a distributor 150 within an evaporator 158. FIG. 16A is a side view of the distributor 150 from FIG. 15 shown alone. The distributor 150 has a main body that houses a flow conditioner 152 and has apertures 154, where in the embodiment shown are disposed for example along the length of the main body. The flow conditioner 152 in some embodiments can be a turning vane that directs the flow of the refrigerant mixture as it enters the distributor 150. In the case of the flow conditioner 152 being a turning vane, flow can enter the distributor 150 and the manner of flow of the liquid portion of the refrigerant mixture can be directed or phase biased by the flow conditioner 152 to flow down the majority of the main body inside the distributor and be exited at or proximate the other end. This can provide a concentrated or localized flow of the liquid phase refrigerant, such as at a side(s), other outlet(s), or certain apertures of the distributor. The apertures or orifices 154 are sized to promote gas flow out of the distributor 150, such as for example along the length thereof and in an even, uniform manner.

Figure 16B:
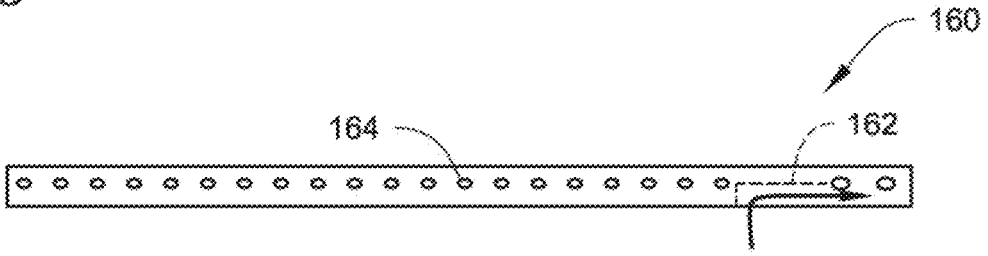
FIG. 16B is a schematic side view of another embodiment of a distributor shown alone.

FIG. 16B is a side view of another embodiment of a distributor 160 shown alone. The distributor 160 also includes a main body that houses a flow conditioner 162, such as a turning vane, and apertures 164 disposed for example along a length portion or length direction of the main body. In the case of the flow conditioner 162 being a turning vane, flow can enter the distributor 160 at one end and be phase biased by the flow conditioner 162 to have liquid be exited at or proximate the same end. The apertures or orifices 164 are sized to promote gas flow out of the distributor 160, such as for example along the length thereof and in an even, uniform manner. This configuration may be useful where the flow entering the distributor 160 is mainly liquid. In such an embodiment as shown in FIG. 16B, the gaseous and liquid portions of the refrigerant mixture can exit the far right end of the distributor 160 and change direction around the end of the flow conditioner 162 and flow toward the left between the flow conditioner 162 and the upper part of the distributor with the apertures. The apertures at the far right begin after the gaseous portion and liquid portion have made this turn around the flow conditioner 162, and accelerated to the left.

The distributors described herein are designed to provide a desirable injection of the gaseous portion of the refrigerant mixture to achieve suitable heat transfer while reducing refrigerant charge. For example, gaseous distribution from the distributor into the shell can be a relatively uniform injection of gas along the length of a shell and tube evaporator, while injecting the majority of liquid at localized positions, e.g. at one end or both ends. In operation, the distributors have an inlet that can accept a refrigerant mixture, usually in two phase gas and liquid forms. A flow conditioner 152, 162, e.g. turning vane or other flow director or contour, within the distributor wall can allow for a suitable momentum to be imparted to the liquid phase of the refrigerant mixture so that it can be forced down toward terminal end(s) thereof. At such location(s), the liquid can be injected out of the distributor and into the volume within the shell of the evaporator. This biased liquid feed of the refrigerant can facilitate operation of a flowing pool associated with excellent oil management and recovery, while providing suitable distribution of the refrigerant.

It will be appreciated that the flow conditioner may not be a turning vane and can be constructed as any suitable flow director or contour that would achieve the phase biased distribution, e.g. of separating or concentrating the liquid portion of the refrigerant mixture from the gaseous portion and allowing for balanced distribution of the gaseous portion into the volume of the shell. It will also be appreciated that the liquid portion can be distributed at various desired locations, for example at one or both ends of the distributor, and in some embodiments where appropriate distribution of the liquid portion can be concentrated toward the center, for example where momentum of the refrigerant mixture may come from the end(s). It will also be appreciated that distribution location of the liquid portion can be at non-centered location(s) but away from the ends. One or more flow conditioners may be implemented in order to achieve the desired refrigerant flow/distribution.

In terms of the gas which enters the distributor through the inlet, the distributors herein can in some instances relatively uniformly inject the gas phase along the length of the evaporator through the apertures, e.g. apertures 154, 164. It will be appreciated that the placement, sizing, and quantity of holes can vary to facilitate and help achieve the desired distributed injection. The distributors herein are directed to leveraging the different properties of gas and liquid, e.g. density, in order to provide the phase biased effect. For example, refrigerant gas is less dense than refrigerant liquid. The flow conditioner can leverage this property to create momentum to force the liquid to the desired exit location, such as toward the other end from the inlet, if needed. The gas has significantly less momentum and can be fed through the apertures of the distributor. Injection of the gas relatively evenly or balanced can result in a desired operation and thermal performance, for example in a flooded evaporator, to better distribute the refrigerant mixture by avoiding relatively higher localized loft of liquid droplets above the tube bundle (e.g. higher velocities) compared to other areas that may be subject to lower localized loft (e.g. lower velocities), which may not be suitable for adequate wetting of the tubes. Likewise, excessive loft can introduce droplets or liquid into the suction stream which is not desired.

FIGS. 17A through 19B show views of another embodiment of a distributor 170 disposed at a bottom of an evaporator shell 180. The distributor 170 includes a flow conditioner 172 which is disposed within a main body of the distributor 170. In some embodiments, the flow conditioner 172 can be constructed as a turning vane. The main body can be composed of two plates, a top plate 174 and a bottom plate 176, each of which has apertures that allow for refrigerant distribution, e.g. gas therethrough. The distributor 170 can have an overall triangle shaped pitch when viewed from an end thereof, but this is merely exemplary as other geometries may be used. An opening 178 from the flow conditioner 172 into the space defined within the bottom plate 176 allows for the direction of liquid refrigerant to exit the area within the flow conditioner 172, turn around the flow conditioner 172 and be directed toward the other end of the distributor 170. Gas can exit the apertures of the top and bottom plates 174, 176, which in some embodiments can have their apertures positioned relatively offset from one another and have relatively different sizes (see FIGS. 18A-19B). It will be appreciated that the size and geometry the apertures of the top and bottom plates 174, 176 can be varied as appropriate to achieve desired and/or needed distribution.

Figure 17A:
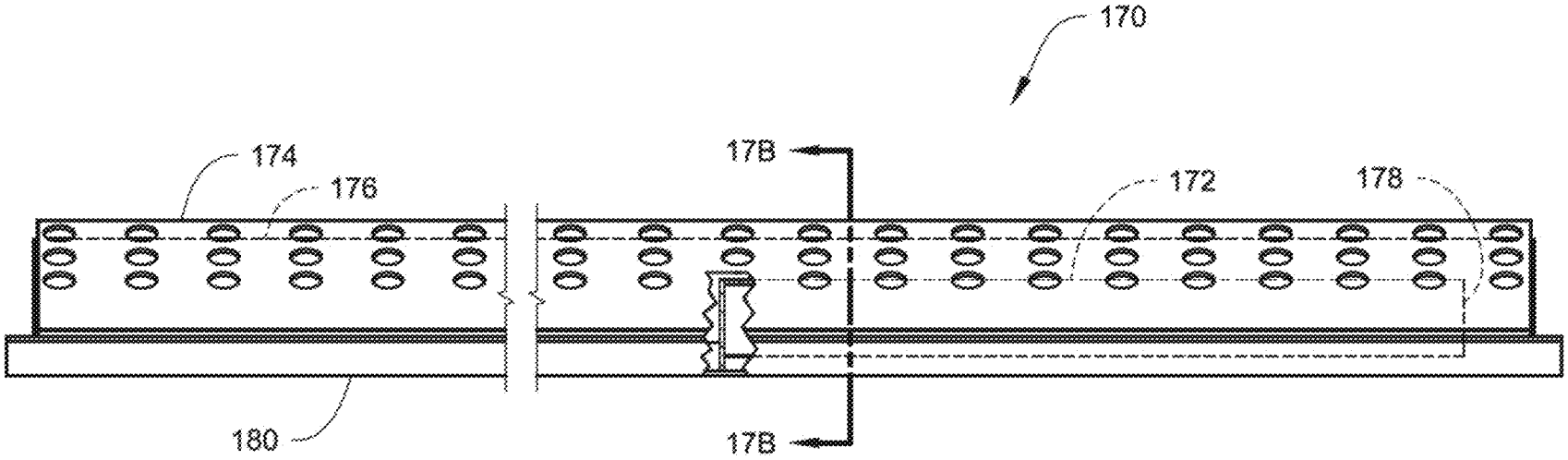
FIG. 17A is a partial side sectional view of another embodiment of a distributor.
Figure 17B:
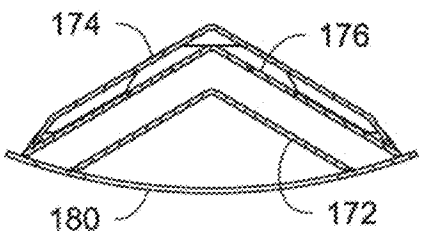
FIG. 17B is a sectional view taken from line 17B-17B in FIG. 17A.
Figure 18A:
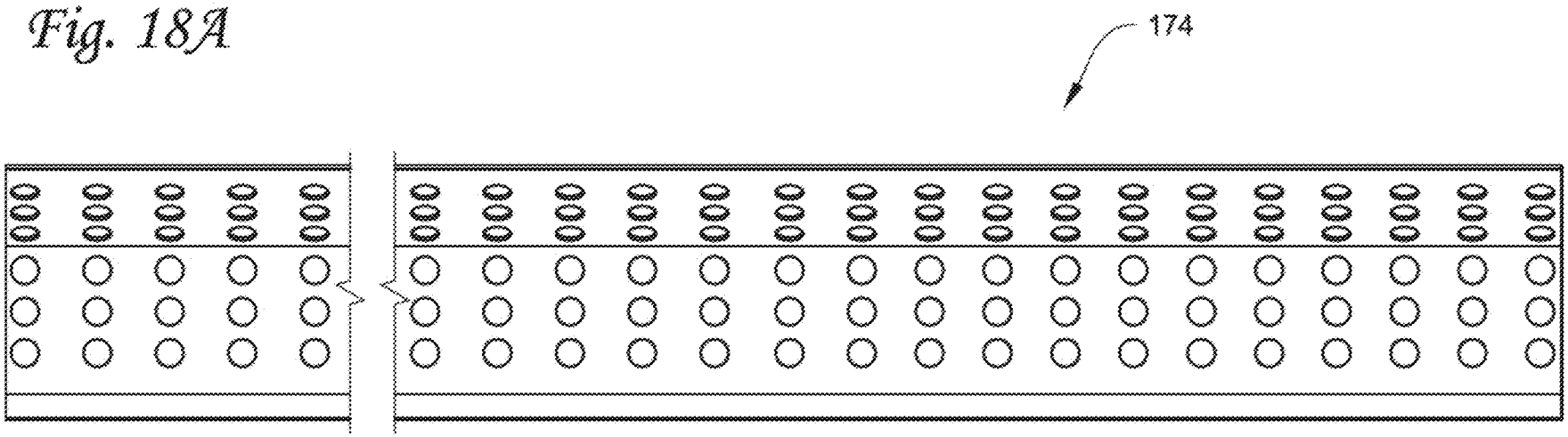
FIG. 18A is a side view of one embodiment of the top distributor plate from FIGS. 17A-B.
Figure 18B:
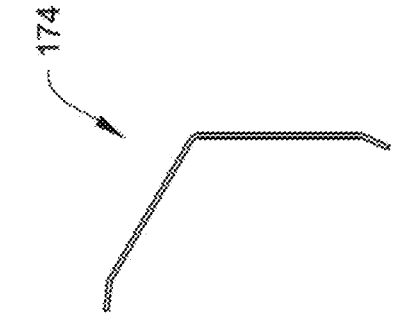
FIG. 18B is an end view of the top distributor plate of FIG. 18A.
Figure 19A:
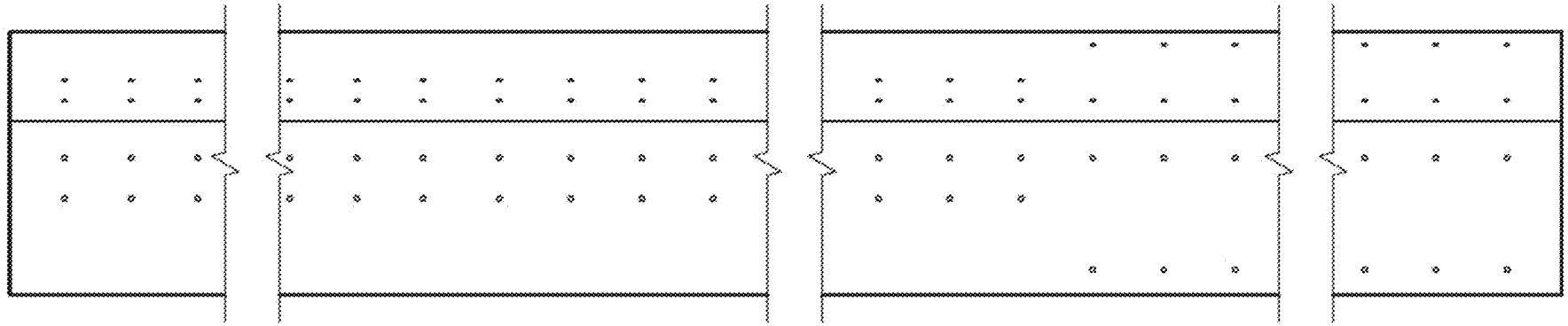
FIG. 19A is a side view of one embodiment of the bottom distributor plate from FIGS. 17A-B.
Figure 19B:
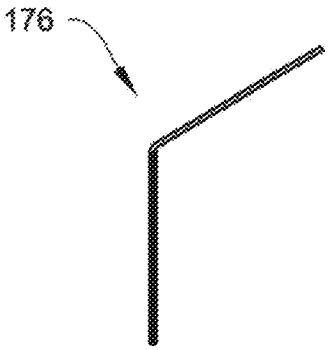
FIG. 19B is an end view of the bottom distributor plate of FIG. 19A.
Figure 20:
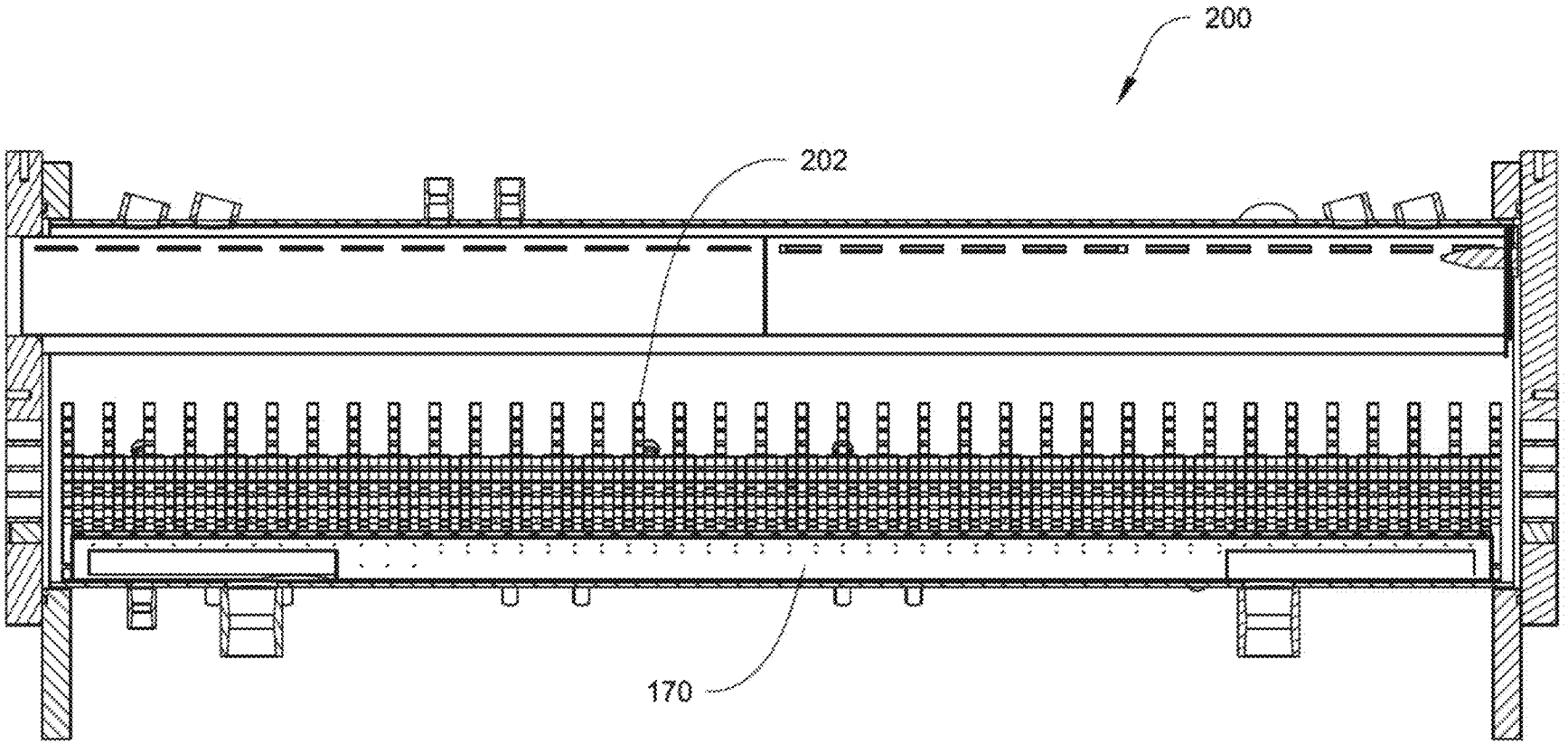
FIG. 20 is a side sectional view of one embodiment of an evaporator in which one embodiment of a refrigerant displacement array and the distributor of FIGS. 17A-B are implemented.

FIG. 20 is a side sectional view of one embodiment of an evaporator 200 in which one embodiment of a refrigerant displacement array 202 and the distributor 170 of FIGS. 17A-B are implemented. As shown, the refrigerant displacement array can have solid material, e.g. spacers and bottom of baffle near the shell, but where there is an alternative pattern of full and partial height baffles to allow for the refrigerant mixture to freely move in this volume in the shell and through openings, through holes of the baffles. As shown, the distributor in some cases may have two flow conditioners that receive refrigerant mixture from two inlets and can direct the refrigerant flow.

Figure 21:
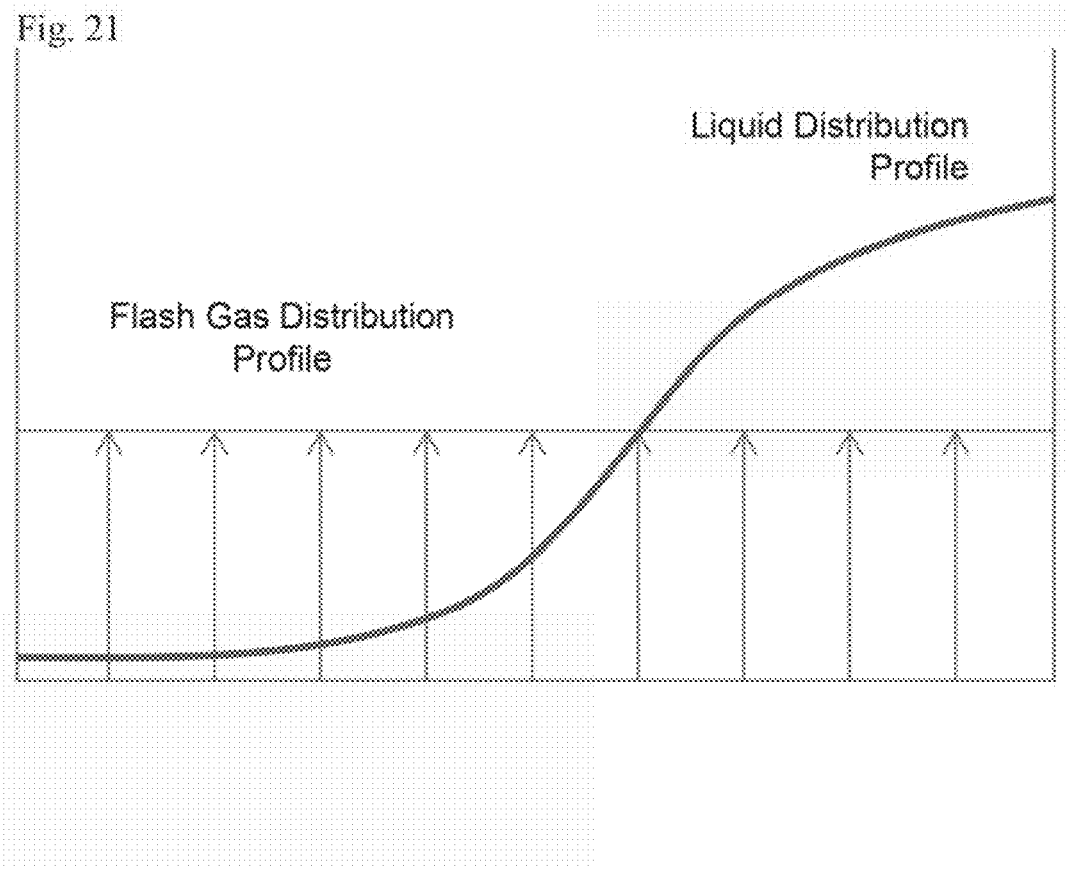
FIG. 21 is a schematic representation of one embodiment of a phased biased flow pattern from a distributor.

FIG. 21 is a schematic representation of one embodiment of a phased biased flow pattern from a distributor. The upward arrow lines represent gaseous refrigerant flow/distribution leaving a distributor such as from its apertures. The solid profile line rising from left to right represents one example of the liquid refrigerant flow/distribution from the distributor. It will be appreciated that the liquid refrigerant flow/distribution can vary depending upon the configuration of the flow conditioner, such as a turning vane, and the desired location at which liquid refrigerant concentration is desired.

In the approach of controlling the interstitial two-stage velocity of refrigerant flow within the volume of the shell of an evaporator, either or both of the refrigerant displacement array and the phase biased distributor can be used to facilitate attaining desired or target interstitial velocity of the refrigerant flow. In some embodiments, a target interstitial velocity may be about 5 ft/s, but may be higher or lower depending upon system operation, load and depending on certain oil management/recovery goals. In some embodiments, the threshold interstitial velocity may be about 3 ft/s, under which bubbly flow may occur. It will be appreciated that a row by row analysis of the tube bundle could be tested to determine the threshold and target velocities, and perhaps to assess whether a refrigerant displacement array could be used, is desired and/or is needed. In other instances, the tube pitch of the tube bundle may be modified to help obtain the target interstitial velocity. For example, for low pressure refrigerants the tube pitch and lanes can be modified, for example by decreasing the available volume or space in the shell so that the interstitial velocity can be obtained. As one example only, the tube pitch could be reduced to allow for about as low as 3/16 inch spacing/distance between the outer surfaces of the tubes, for example, while still being suitable for typical tube sheet/support assembly. In some examples, a ratio of tube pitch (P) and tube diameter (D) can be used to determine the tube bundle design. As one example only, a ratio of about $1.16<P/D<$about 1.375 may be used to determine the tube bundle configuration. The tube pitch could be locally enlarged, for example, toward the top of the bundle, where the tube pitch may not be constant throughout. Likewise, it will be appreciated that the tube openings of a baffle array, if used, could be modified as needed to accommodate different tube spacing and pitch among tube bundles.

Generally, one embodiment of a method of refrigerant management includes causing refrigerant to enter a volume present inside a shell of an evaporator, and wetting outer surfaces of tubes in a tube bundle with the refrigerant. The step of wetting includes attaining a spray flow of the refrigerant through the interstitial volume of the shell including between outer surfaces of the tubes of the tube bundle. The step of attaining a spray flow of the refrigerant includes maintaining a target interstitial velocity of refrigerant flow suitable to attain the spray flow of refrigerant above a threshold interstitial velocity that does not attain the spray flow of refrigerant. For example, maintaining a target interstitial velocity includes maintaining an interstitial two-phase velocity above a threshold, below which a relatively higher liquid, i.e. bubbly flow, can exist which is not desired. The refrigerant inside the shell is evaporated by way of heat transfer with a process fluid traveling through the tubes of the tube bundle and evaporated refrigerant is released from the shell.

Anti-Foaming Surfaces

In the approach of using anti-foaming surfaces, one method of refrigerant management in an evaporator of a HVAC chiller includes causing refrigerant to enter a volume present inside a shell of an evaporator, and wetting outer surfaces of tubes in a tube bundle with the refrigerant. Refrigerant inside the shell is evaporated by way of heat transfer with a process fluid traveling through the tubes of the tube bundle. The formation of foam by one or more of the refrigerant and lubricant during the evaporating step is reduced, such as by reducing a height of a foam layer that may be present above the refrigerant mixture. The step of reducing formation of foam includes causing the refrigerant to interact with anti-foaming surfaces present within the shell. The evaporated refrigerant is released from the shell.

One embodiment of a refrigerant management system for an evaporator of an HVAC chiller has the anti-foaming surfaces. The system includes a shell having a volume to receive a refrigerant mixture therein, the mixture of which may include a lubricant. A tube bundle is disposed inside the shell. The tube bundle includes tubes extending within the shell to pass a process fluid therethrough and to undergo heat transfer with the refrigerant. Anti-foaming surfaces are disposed within the volume of the shell. The anti-foaming surfaces are arranged and configured inside the shell to interact with the refrigerant mixture and are suitable to prevent or at least reduce foaming that may occur.

In some embodiments, the anti-foaming surfaces can be one or both of refrigerant phobic surfaces and lubricant phobic surfaces disposed within the volume of the shell. In some embodiments, such surfaces can be created through use of certain materials, and may be applied for example as a coating, surface enhancement, mesh, or combinations thereof, that can still allow for refrigerant vapor flow and that is phobic enough to not coat the material used.

Generally, use of refrigerant and/or oil phobic materials, such as on surfaces inside of an evaporator of a water chiller in an HVAC system, can be used to reduce or prevent foaming of the refrigerant mixture. For example, such surfaces may be applied on surfaces of other structures inside the shell of the evaporator including for example displacement baffles, or can be applied on the copper tubes inside the tube/shell evaporator. Additionally, such surfaces may be in the form of a mesh that can be used to disrupt and destabilize bubble formation.

The refrigerant phobic and lubricant phobic surfaces can be present on one or more of spacers arranged and configured within the shell and of baffles having openings through which the tubes are inserted. In general, the refrigerant phobic and lubricant phobic surfaces can be present on one or more of inner surfaces of the shell and of outer surfaces of the tube bundle.

Materials that can be used to make such surfaces include polymeric, plastics such as polypropylene, polyethylene, or Teflon; galvanized or aluminum iron materials; inorganic coatings; or a combination of such materials. The use of such materials destabilizes bubbles that may form during the evaporation process, and reduces the amount of foam in the refrigerant/lubricant mixture.

It will be appreciated that anti-foaming surfaces may be created through use of known or novel materials, coatings, surface enhancements, novel mesh material, and combinations thereof. In some embodiments, the anti-foaming surfaces can be one or both of refrigerant phobic surfaces and lubricant phobic surfaces disposed within the volume of the shell. It will be appreciated that materials may also utilize surface enhancements that have been created to create a refrigerant phobic and/or lubricant phobic surface. The use of such surface enhancement, which may include but are not limited to milli, micro-, and/or nano-scale structures, destabilizes bubbles that may form during the evaporation process, and reduces the amount of foam in the refrigerant/lubricant mixture.

It will also be appreciated that the use of anti-foaming surfaces is not limited to evaporators as other apparatuses, devices, and components of HVAC systems including but not limited to chillers may employ such anti-foaming surfaces. For example, such refrigerant management approach may be employed in an oil and/or refrigerant tank or source of HVAC chillers.

For example, another method of refrigerant management in an oil and/or refrigerant tank of a HVAC chiller includes causing refrigerant to enter a volume present inside a shell of a tank. Refrigerant inside the shell is flashed to vapor by way of pressure equalization. The formation of foam by one or more of the refrigerant and lubricant, such as for example during the flashing step, is reduced. Foam may occur through agitation and flashing of the refrigerant. The step of reducing formation of foam includes causing the refrigerant to interact with anti-foaming surfaces present within the shell of the tank.

In another embodiment of a refrigerant management system, an oil/refrigerant tank of an HVAC chiller has the anti-foaming surfaces. The system includes a shell having a volume to receive a refrigerant/oil mixture therein. Anti-foaming surfaces are disposed within the volume of the shell. The anti-foaming surfaces are arranged and configured inside the shell to interact with the refrigerant mixture and are suitable to prevent or at least reduce foaming that may occur.

In some embodiments, the anti-foaming surfaces can be one or both of refrigerant phobic surfaces and lubricant phobic surfaces disposed within the volume of the shell. These surfaces may be created through material usage, coatings, surface enhancements, or mesh.

Generally, the use of refrigerant and/or oil phobic materials, such as on surfaces inside of a refrigerant and/or lubricant source or tank of a water chiller in an HVAC system, can reduce or prevent foaming of the refrigerant mixture. For example, such surfaces may be applied on surfaces of other structures inside the tank, including for example tank baffles or tank internal surfaces. Additionally, such surfaces may be in the form of a mesh that can be used to disrupt and destabilize bubble formation.

Materials that can be used to create such surfaces include polymeric plastics such as polypropylene, polyethylene, or Teflon; galvanized or aluminum iron materials; inorganic coatings; or a combination of such materials. The use of such materials destabilizes bubbles that may form during the refrigerant flashing process, and reduces the amount of foam in the refrigerant/lubricant mixture. Materials may also utilize surface enhancements that have been created to create a refrigerant phobic and/or lubricant phobic surface. The use of such surface enhancement, whether they are milli, micro, or nano scale structures, destabilizes bubbles that may from during the refrigerant flashing process, and reduces the amount of foam in the refrigerant/lubricant mixture.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. A method of refrigerant management in a flooded evaporator of a heating, ventilation, and air conditioning (HVAC) chiller, comprising:

causing a refrigerant mixture to enter a distributor, the distributor having a main body, the distributor being disposed at a bottom portion of a shell that has a volume therein, the distributor being positioned below a plurality of tubes in a tube bundle;

directing the refrigerant mixture to enter the volume present inside the shell via the distributor, and redirecting the refrigerant mixture using a flow conditioner housed in the main body of the distributor, wherein the flow conditioner is a turning vane directing flow of the refrigerant mixture in a longitudinal direction toward an end of the shell as the refrigerant mixture enters the distributor, changing a direction of the refrigerant mixture to turn at least 180 degrees around the turning vane from a side facing an inlet of the shell around to another side facing away from the inlet of the shell, and directing the flow of the refrigerant mixture in the longitudinal direction toward an opposite end of the shell, whereby the redirecting includes:

imparting a momentum to a liquid portion of the refrigerant mixture to feed the liquid portion from one or more designated locations of the main body of the distributor into the volume inside the shell by the flow conditioner, feeding a gaseous portion of the refrigerant mixture into the volume inside the shell from injection apertures formed in the main body of the distributor and disposed along a length direction of the distributor, and releasing the liquid portion and the gaseous portion from the distributor in a phase biased manner such that the liquid portion concentrates at the one or more designated locations and the gaseous portion flows from the injection apertures of the distributor;

wetting outer surfaces of the plurality of tubes in the tube bundle with the refrigerant mixture; and evaporating the refrigerant mixture inside the shell by way of heat transfer with a process fluid traveling through the plurality of tubes in the tube bundle and releasing the refrigerant mixture as evaporated from the shell.

2. A refrigerant management system for a flooded evaporator of a heating, ventilation, and air conditioning (HVAC) chiller, comprising:

a shell having a volume to receive a refrigerant mixture therein, an inlet to receive the refrigerant mixture inside the volume of the shell, and an outlet to release from the shell a portion of the refrigerant mixture evaporated from the refrigerant mixture;

a tube bundle disposed inside the shell, the tube bundle including tubes extending within the shell to pass a process fluid therethrough and to undergo heat transfer with the refrigerant mixture; and a distributor disposed at a bottom portion of the shell below the tube bundle, the distributor including a main body, a flow conditioner within the main body, and injection apertures in the main body disposed along a longitudinal direction of the distributor, the flow conditioner including a turning vane having a wall and an end, the turning vane being under the main body and the injection apertures, the wall of the turning vane extends in the longitudinal direction, the wall and the end are configured to direct flow of the refrigerant mixture in the longitudinal direction toward an end of the shell as the refrigerant mixture enters the distributor, configured to change a direction of the refrigerant mixture to turn around the wall and end of the turning vane from a side of the wall facing the inlet around to another side of the wall facing away from the inlet, and configured to direct the flow of the refrigerant mixture in the longitudinal direction toward an opposite end of the shell, whereby the turning vane is configured to impart a momentum to feed a liquid portion of the refrigerant mixture from one or more designated locations of the distributor into the volume inside the shell, the liquid portion of the refrigerant mixture being concentrated at the one or more designated locations, the injection apertures configured to feed a gaseous portion of the refrigerant mixture into the volume inside the shell from the injection apertures, and the turning vane and the injection apertures are configured to distribute the refrigerant mixture into the volume of the shell so that the liquid portion and the gaseous portion are distributed in a phase biased manner.

3. The method according to claim 1, wherein the one or more designated locations include an end of the distributor in the longitudinal direction.

4. The method according to claim 1, wherein the one or more designated locations include a plurality of designated locations, the plurality of designated locations including ends of the distributor in the longitudinal direction.

5. The refrigerant management system according to claim 2, wherein the one or more designated locations include an end of the distributor in the longitudinal direction.

6. The refrigerant management system according to claim 2, wherein the one or more designated locations include a plurality of designated locations, the plurality of designated locations including ends of the distributor in the longitudinal direction.

7. The method according to claim 1, wherein the gaseous portion released from the distributor is released in an even, uniform manner.

8. The method according to claim 1, wherein releasing the liquid portion from the distributor includes releasing the liquid portion at a same end of the distributor as the flow conditioner.

9. The refrigerant management system according to claim 2, wherein the gaseous portion is configured to be released from the distributor in an even, uniform manner.

10. The refrigerant management system according to claim 2, wherein the liquid portion is configured to be released from the distributor at a same end of the distributor as the flow conditioner.

* * * * *